US007024848B2

(12) United States Patent
Stalder et al.

(10) Patent No.: US 7,024,848 B2
(45) Date of Patent: Apr. 11, 2006

(54) TUNNEL CLADDING

(75) Inventors: Herbert Stalder, Kollbrunn (CH); Olivier Wüst, Seuzach (CH)

(73) Assignee: Maschinenfabrik Rieter AG, Winterthur (CH)

( * ) Notice: Subject to any disclaimer, the term of this patent is extended or adjusted under 35 U.S.C. 154(b) by 262 days.

(21) Appl. No.: 10/392,284

(22) Filed: Mar. 19, 2003

(65) Prior Publication Data

US 2004/0016223 A1 Jan. 29, 2004

(30) Foreign Application Priority Data

Mar. 20, 2002 (CH) ..... 0485/02

(51) Int. Cl.
*D01H 7/00* (2006.01)

(52) U.S. Cl. ..... 57/315; 57/350

(58) Field of Classification Search ..... 57/333, 57/350, 400

See application file for complete search history.

(56) References Cited

U.S. PATENT DOCUMENTS 5,295,349 A 3/1994 Okamoto
5,419,110 A 5/1995 Mikami et al.
5,528,895 A 6/1996 Deno
5,647,197 A * 7/1997 Imamura ..... 57/328
5,927,062 A * 7/1999 Deno et al. ..... 57/333
6,679,044 B1 * 1/2004 Anderegg ..... 57/333
6,782,685 B1 * 8/2004 Bischofberger et al. ..... 57/5

FOREIGN PATENT DOCUMENTS

DE 3810860 A1 11/1988

OTHER PUBLICATIONS

EPO Search Report, May 30, 2003.

* cited by examiner

*Primary Examiner*—John J. Calvert
*Assistant Examiner*—Shaun R. Hurley
(74) *Attorney, Agent, or Firm*—Dority & Manning, P.A.

(57) ABSTRACT

The application relates to a device for air spinning, i.e., for the manufacture of a spun yarn from a sliver. The device contains in particular a fiber guide element, a fiber conveying channel, and an eddy chamber housing attached to the fiber guide element. The eddy chamber housing contains in its turn a spindle with a yarn guide channel arranged at a distance interval from the fiber guide element. In addition, the eddy chamber housing contains a fluid device with at least one jet nozzle for the production of an eddy current about an inlet aperture mouth of the yarn guide channel. The fiber conveying channel exhibits a tunnel cladding, which is dimensioned in such a way that at the end of the fiber conveying channel a step to the eddy chamber housing is formed.

16 Claims, 5 Drawing Sheets

PRIOR ART

PRIOR ART

I-I
13.1
15
13.1
17
3
4
13.1
13.1

3
20
6
17.1
18

II
8
7
19
15
14.1
18
13.1
20
18
α
13.1
I
I
17
4
3
II

II-II
18
13.1
20
20
18
13.1
I
I
3

23
20
18
α
13.1
22
I

I
13.1
21
19
L
13.1α
3

1-1
α
3

11
9
10
7
12
25
23
24
22

TUNNEL CLADDING

BACKGROUND OF THE INVENTION

The present invention relates to a device for the manufacture of a spun yarn or thread from a staple sliver.

Devices are known in the textile art that are used for air spinning processes. Such a device is disclosed, for example, by Specification EP 854 214 (equivalent to U.S. Pat. No. 5,927,062), which is shown in FIG. 1. It can be seen how a sliver 1 is delivered from a pair of delivery rollers 2 (in most cases a drafting device) and runs through a fiber guide element 3.1. The fiber guide element 3.1 exhibits a fiber conveying channel 4 with a helically-shaped fiber guide surface 5, whereby this ends at a fiber delivery edge 6. Arranged at a certain distance from the fiber guide element 3.1, and from the fiber delivery edge 6 respectively, is a spindle 7 with a yarn guide channel 8 and an inlet aperture mouth 9 allocated to the yarn guide channel 8. Between the fiber guide element 3.1 and the inlet aperture mouth 9 is a fluid device for generating an eddy current around the inlet aperture mouth 9 (fluid device not shown). The fluid device generates an eddy current 11 around the inlet aperture mouth 9, and around the spindle 7, respectively, in the area 14. FIG. 1 shows the air spinning device in diagrammatic form only. The space 14 is normally enclosed by a housing and can therefore be designated as an eddy chamber (14.1, see following Figures). As a fluid, compressed air is usually used. Due to the eddy current 11 which is created, the free fiber ends 12 of the sliver 1 lie around the inlet aperture mouth 9. As a result of the movement of the sliver 1 in the direction of the arrow, a relative rotating movement of the free fiber ends 12 is created around the inlet aperture mouth 9, and, as a result, around the sliver 1. From the sliver 1, a spun yarn 10 is accordingly derived.

The present invention is concerned with the guidance of the fluid (air) flowing out of the fluid device. It is concerned in particular with the area of the eddy chamber 14.1 in the immediate vicinity of the outlet apertures for the fluid.

A further instance of the prior art, according to Japanese Specification JP 3-10 63 68, is shown in FIGS. 2 and 2*a*. In FIG. 2, essentially the same components are shown as in FIG. 1 (with one change, see FIG. 2*a*). In particular, the pair of delivery rollers 2 and the spindle 7 with the yarn guide channel 8 can be identified. By analogy with FIG. 1, a fluid device creates an eddy current here also. In this situation, the fluid device consists of several jet nozzles 13.1. The jet nozzles consist as a rule of cylindrical holes, or apertures, from which the fluid (air is preferred) is introduced under pressure into the eddy chamber 14.1. The eddy chamber 14.1 has a circular cross-section. As a result of the direction of flow created by the arrangement of the holes and due to the circular cross-section of the eddy chamber 14.1, the compressed air flowing in creates an eddy flow around the inlet aperture mouth 9 of the spindle 7. As can be seen from FIG. 2, the fiber guide element 3.1 includes a casing jacket 3*a*, which also forms the fiber conveying channel 4. Connected directly to this Figure, the fluid device (represented by the holes or jet nozzles 13.1) is integrated into the casing jacket of the fiber guide element 3*a*. In the device shown, the eddy chamber housing 15 and the casing jacket of the fiber guide element 3*a* are two separate components. It is, however, entirely possible, and known from the prior art, for both components to be designed also as one element (as a single piece). Whether these elements are designed as single pieces or as separate components is not of significance to the present application.

In FIG. 2*a*, the fiber guide elements 3.1 of FIG. 2 is shown in a three-dimensional view. By contract with FIG. 1, the fiber guide elements 3.1 in FIG. 2 does not exhibit a helical but rather a flat fiber guide surface 5.1. A further difference between this and FIG. 1 les in the absence of a fiber delivery edge. Instead of the fiber delivery edge, the fiber guide elements part 3*b* exhibits a truncated cone shape. The purpose of this cone 3*b* is to produce what is referred to as a false yarn core.

The intention of this is to prevent a false twist (incorrect rotation of the sliver) from the inlet aperture mouth 9 extending backwards through the fiber guide element 3.1 as far as against the clamping gap of the par of delivery rollers 2 (referred to as twist stop). A false twist prevents a correct twist or rotation of the free fiber ends about the (untwisted) yarn core. In the event of a false twist, the core of the sliver rotates with the free fiber ends and prevents the spinning of the fibers. With the prior art according to FIG. 1, the twist stop is achieved by the helical shaped fiber guide surface 5, which is intended to render impossible the rotation of the sliver 1 towards the delivery rollers 2.

Another instance of prior art which relates to the device according to the invention is to be found in a patent application from Applicants still unpublished at the time of this application (International Application Number: PCT-CH-01-00569).

OBJECTS AND SUMMARY OF THE INVENTION

A principal object of the present invention is the improvement of the flow conditions in the eddy chamber and, therefore, an improvement of the yarn values of the yarn which is produced. In particular, it is intended that the area of the eddy chamber in the immediate vicinity of the outlet apertures of the jet nozzles should be improved in terms of flow technology. Additional objects and advantages of the invention will be set forth in part in the following description, or may be obvious from the description, or may be learned through practice of the invention.

The principal object of the invention is achieved by a fiber conveying channel exhibiting a tunnel cladding which is shaped in such a way that, at the end of the fiber conveying channel, a shoulder to the eddy housing is formed. The front face of the shoulder serves as a deflection guide surface for the fluid, which emerges from a jet nozzle.

Experiments with air spinning devices designed in accordance with the invention have surprisingly shown that the air inflow through the fiber conveying channel with a tunnel cladding and an appropriately designed step arrangement, as well as a favorable design of the face surface of the fiber guide element delimiting the eddy chamber, can effect an increase of up to 50% in the inflowing air volume. Further experiments have shown that the unexpected improvements in the flow conditions are attributable to two different effects. On the one hand, the reduction of the cross-section of the fiber conveying channel due to the tunnel cladding produces the unexpected effect of increasing air volume flowing through. On the other, a deliberate arrangement of the step of the tunnel cladding to the eddy chamber housing has the effect of a substantial improvement in the flow conditions in the chamber itself. The deliberate design of the step as baffle plate has an unexpected effect on the air (or other fluid) emerging from the jet nozzles. This design incurs an improvement in the flow conditions in the eddy chamber, as well as an improvement in the flow conditions in the fiber conveying channel. The face surface of the fiber guide element which delimits the eddy chamber can likewise be designed in such a way that is serves as a deflection guide surface for the eddy flow. In a further embodiment of the invention, the face surface can be designed in such a way that it, at least, does not disturb the eddy flow (due to the fact that the face surface exhibits a greater inclination than the direction of flow of the emergent fluid). In both cases the adaptation of the face surface also improves the effect according to the invention.

Due to the increased air flow and the air throughput (quantity per time unit), respectively, through the fiber conveying channel the fiber guidance occurs between the delivery rollers and the entrance to the fiber conveying channel (see FIG. 1 or 2). The increased air flow through the fiber conveying channel "sucks" the continuous strip of loose staple fibers more intensively into the fiber conveying channel. The individual fibers in the sliver are better aligned by this flow, and the sliver is less inclined to "flutter" before running into the fiber conveying channel (caused by the air flow around the rotating delivery rollers). The number of production interruptions caused by breaks in the sliver immediately after the delivery rollers can be reduced by the arrangements according to the invention. Likewise, a measurable improvement in the yarn quality can also be determined.

The invention is further explained hereinafter on the basis of embodiments represented in the Figures, whereby the invention is not restricted to the embodiments shown in the examples.

DETAILED DESCRIPTION

Reference will now be made in detail to the presently preferred embodiment of the invention, one or more examples of which are shown in the figures. Each example is provided to explain the invention and not as a limitation of the invention. In fact, features illustrated or described as part of one embodiment can be used with another embodiment to yield still a further embodiment. It is intended that the present invention cover such modifications and variations.

Figures 3, 3A, 3B, 3C:
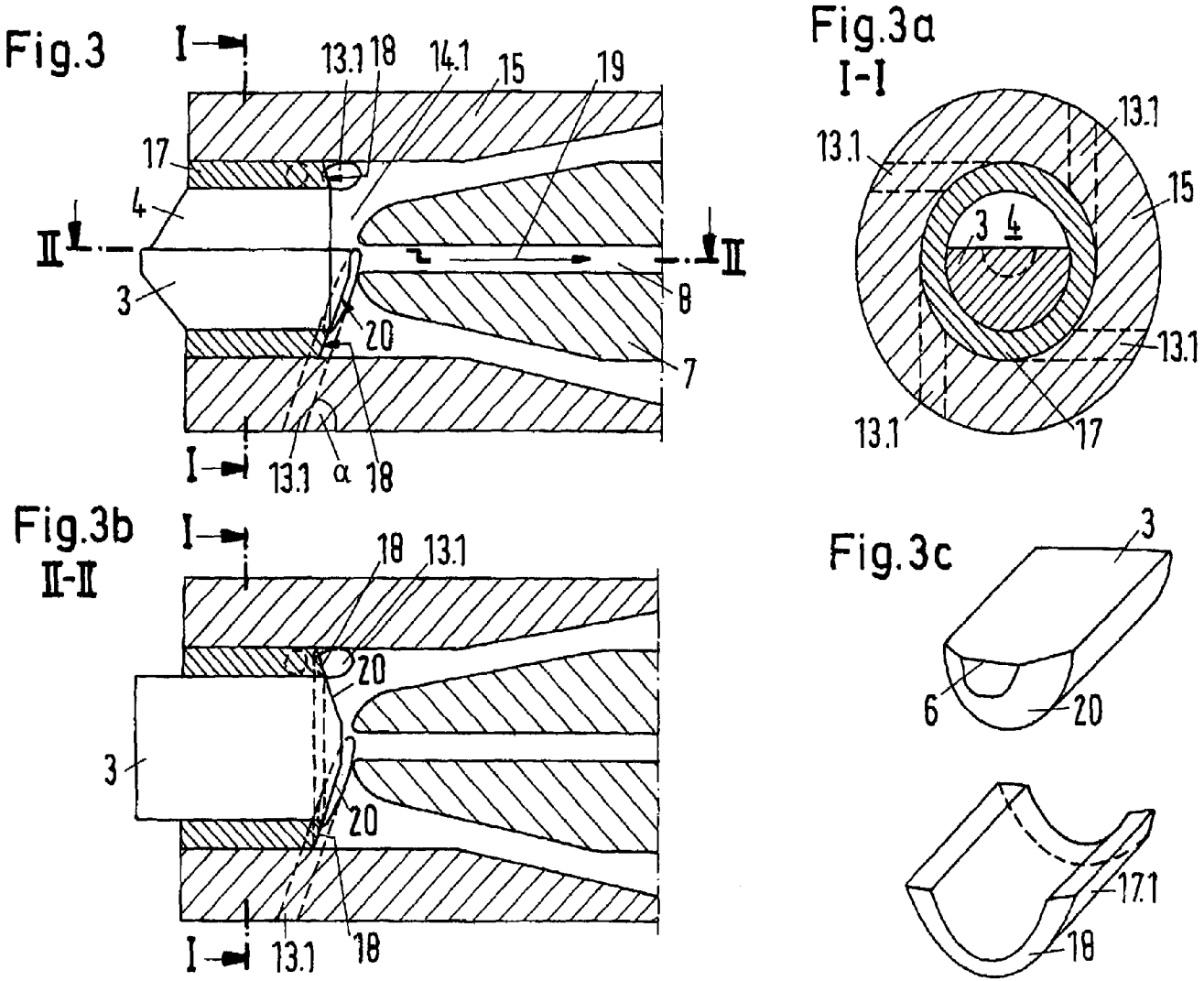
FIG. 3 shows a first cross-sectional view of embodiment of the invention.
FIG. 3*a* shows a first sectional view of the device as seen along section I—I according to embodiment shown in FIG. 3.
FIG. 3*b* shows a second sectional view of the embodiment as seen along section II—II according to FIG. 3.
FIG. 3*c* shows a fiber guide element and half-shell of a tunnel cladding.

FIG. 3 shows a first embodiment of the invention. The intention is to explain approximately the means of effect according to the invention on the basis of this drawing. In FIG. 3 a fiber guide element 3 can be identified, which is surrounded by a tunnel cladding 17 in the form of a hollow cylinder. The tunnel cladding 17 can be single-piece or multi-piece, preferably two-piece. A fiber conveying channel 4 is surrounded by the tunnel cladding 17. The tunnel cladding 17 is shaped in such a way that, at the end of the fiber conveying channel 4, a step 18 is provided to an eddy chamber housing 15. The face surface of the step 18 serves as a deflection guide surface for the fluid (not shown) emerging from a jet nozzle 13.1. The outlet apertures, or holes, of the jet nozzles 13.1 release the fluid (normally air) into an eddy chamber 14.1 exhibit an elliptical shape (see FIG. 3). In this first embodiment of the invention, the fiber guide element 3 and the tunnel cladding 17 pertaining to it are integrated in the eddy chamber housing 15. As is shown in the following Figures, the eddy chamber housing 15 does not necessarily also have to encompass the fiber guide element 3 and its tunnel cladding 17. The two latter elements can also exhibit their own housing, which delimits the eddy chamber housing 15 (see, for example, FIG. 7). In FIG. 3, the spindle 7 with its yarn guidance channel 8 can also be seen. FIG. 3*a* shows the cross-section of the device according to the invention from FIG. 3 according to the section I—I. It can be seen in this cross-section that the device exhibits four individual jet nozzles 13.1. The invention is not restricted solely to being used on devices with four jet nozzles. This means that it can also be used with less or more than four jet nozzles. It can also be readily seen from FIG. 3 how the jet nozzles 13.1 exhibit an inclination angle $\alpha$ in the direction of the conveying of the fiber (material flow direction 19). The inclination angle $\alpha$ may exhibit a value from about 45° to 88°, but, preferably, the inclination angle to the material flow direction 19 amounts to about 70°. The inclination angle of the face surface of the step 18 to the direction of the material flow in this first embodiment likewise exhibits the same value (about 70°). In this first embodiment of the invention, it can also be readily appreciated how the face surface 20 of the fiber guide element 3 delimiting the eddy chamber 14.1 has the same inclination angle to the direction of material flow 19 as the apertures of the jet nozzles 13.1. The inclination angle of the apertures corresponds to the direction of flow of the emerging fluid. FIG. 3*b* shows a section of this first embodiment according to the invention, according to the section lines II—II. It can be particularly well appreciated here how the face surface 20 of the fiber guide element 3 in the eddy chamber is flush with the face surface of the step 18. It can be further identified from FIG. 3*a* that the holes 13.1 are arranged rotationally symmetrical.

FIG. 3*c* shows a plan view of the fiber guide element 3. It can be readily identified in this that the face surface 20 of the fiber guide element 3 delimiting the eddy chamber exhibits a conical-shaped surface. The conical-shaped face surface 20 is intersected by a surface which forms the fiber delivery edge 6. From FIG. 3*c*, it can be readily appreciated that the face surface 20, with the appropriate design, can have a corresponding effect on the flow in the eddy chamber. Preferably, the face surface 20 accordingly features the same or a larger inclination angle based on the direction of the material flow than the direction of flow of the emerging air (or fluid). As a result of this, the face surface 20 can serve as a guide surface for the emerging fluid, or at least has not interfering effect on the eddy flow. In this Figure, a perspective view, a half-shell of the tunnel cladding 17.1 is also represented. The tunnel cladding can be a single piece or, as represented here, can consist of two half-shells (upper half-shell not represented). Preferably, the face surface of the step 18 and the face surface 20 exhibit the same inclination angle, with the result that both surfaces are flush with one another. As is explained in FIG. 4, however, the face surface 20 can also exhibit a different (greater or smaller) inclination angle than the surface 18.

Figures 4, 4A, 5, 6:
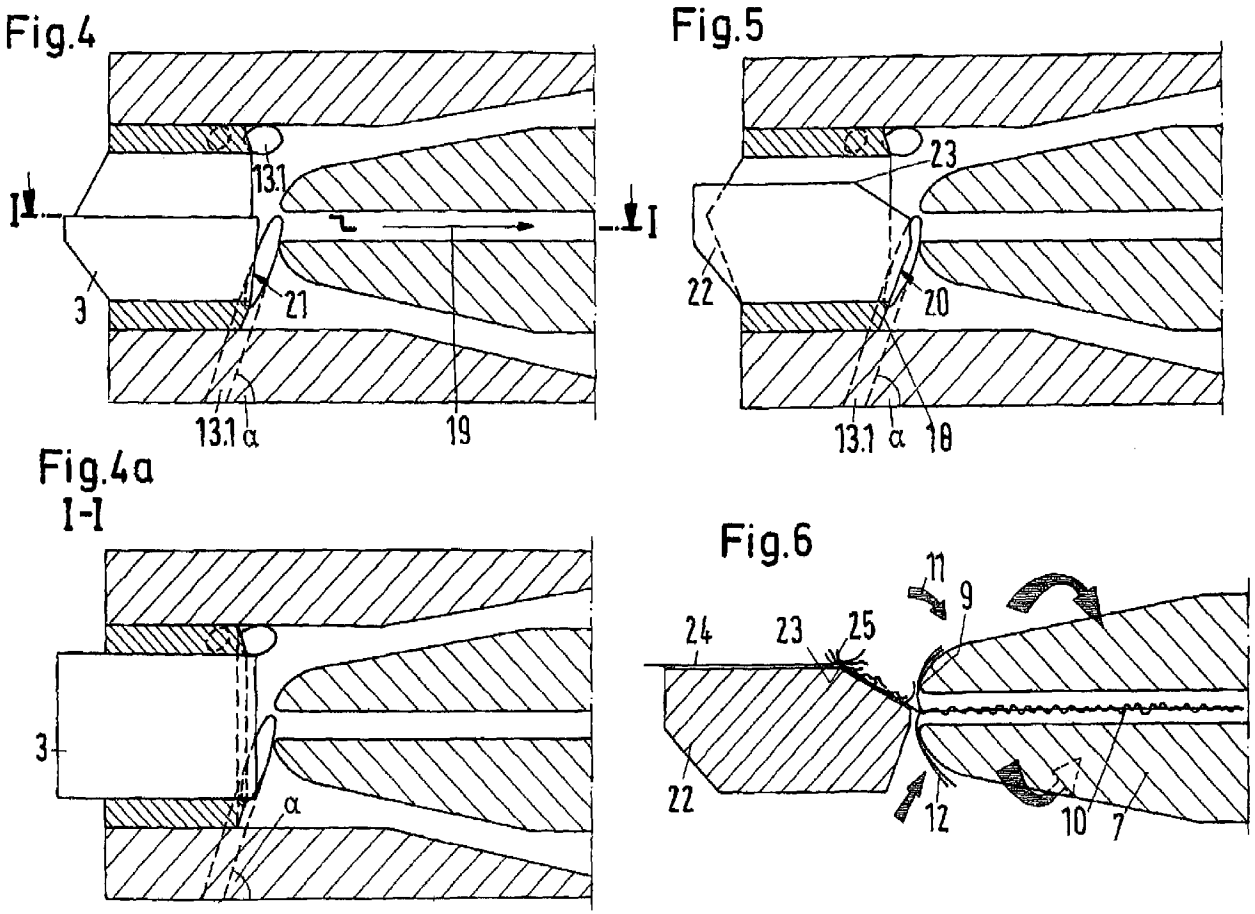
FIG. 4 shows a sectional view of a further embodiment of the invention.
FIG. 4*a* shows a sectional view as seen along section I—I of the embodiment shown in FIG. 4.
FIG. 5 shows a sectional view of a further possible embodiment of the invention.
FIG. 6 shows a diagrammatic representation of the spinning process.

In FIG. 4, an embodiment is shown in which the face surface 21 of the fiber guide element 3 exhibits a greater, i.e., steeper, inclination in the direction of the material flow 19 than in the flow direction of the fluid (exhibits inclination angle α). The surface 21 exhibits a greater (steeper) inclination angle to the material flow 19 than the apertures of the jet nozzles 13.1. In addition, the surface 21 is flat and not conical-shaped. Due to the steeper angle of the face surface 21, this surface has a different effect on the eddy flow. Depending on the application situation, it may transpire to be favorable for this variant of the face surface or another inclination angle to be selected. In addition to the greater (steeper) inclination of the face surface 21, in comparison with the embodiment of the preceding Figures, the surface of the face surface 21 of the fiber guide element 3 in the eddy chamber is also not conical-shaped. This is derived in particular from FIG. 4*a*, which represents a sectional view according to the section line I—I of FIG. 4.

FIG. 5 shows a further embodiment of the invention. The device in FIG. 5 differs in relation to the preceding devices due to the fiber guide element 22. In this case too, the face surface 20 of the fiber guide element 22 in the eddy chamber exhibits the same inclination angle as the jet nozzles 13.1 (inclination angle α). The face surface of the step 18 exhibits the same inclination angle, with the result that the surfaces 18 and 20 form a flush conical-shaped surface. Experiments have shown that it is most favourable if the surface 18 and 20 exhibit the same inclination angle and are located flush with one another. Preferably they also exhibit the same inclination angle as the jet nozzles.

Variants are also conceivable, however, with which (by contrast with FIG. 4) the face surface of the fiber guide element in the eddy chamber exhibits a lesser inclination angle than the step 18 (not shown in the Figures).

Which variant is the most favorable depends on the individual application situation (e.g. on the type of yarn). The idea of the invention therefore also comprises in general the possibility of the surface 18 and 20 exhibiting different inclination angles. In this context, these concepts are not restricted to the variant shown in FIG. 5.

The fiber guide element 22 of FIG. 5 exhibits a deflection point 23. The deflection point 23 is designed as an edge, but other types of deflection points can also be used. The remaining elements of the Figure correspond to the preceding description, as a result of which they are not described in greater detail. The means of effect of the deflection point 23 is explained in the following FIG. 6. Experiments have revealed that, in addition to the use of the step 18 as a deflection guide surface for the air and the adaptation of the face surface 20, also particularly good results can be achieved regarding yarn quality with the use of a deflection point 23.

FIG. 6 attempts to explain approximately the means of effect of the deflection point 23. A more precise explanation of the means of function of such deflection points can be derived from the patent application by Applicants CH 0235/02, still unpublished at the time of this present application. The fiber guide element 22 with the deflection point guides a sliver 24 with a flat arrangement of the fibers in the direction of a spindle 7. At the deflection point 23, the free fiber ends 25 of the fibers in the sliver 24 can be raised (represented by way of example). It can be seen that the free fiber ends 25 encompass both the front as well as the rear fiber ends (corresponding to the fibers extending to left or right of the deflection point 23). For example, it can be recognized how the sliver 24, after passing the deflection point 23 exhibits more free fiber ends at or on the surface of the sliver 24. The deflection point accordingly increases the number of free fiber ends on or in the immediate vicinity of the surface of the sliver. These free fiber ends can therefore be better acquired by an eddy flow 11 (or more free fiber ends are acquired, respectively,) and laid around the inlet aperture mouth 9. In this way, more free fiber ends can be spun, or more of what are referred to as cover fibers are produced, which inherently improves the spinning process and the quality. The spun yarn 10 accordingly has a higher proportion of cover fibers and, therefore, greater strength than yarns from spinning devices without deflection points.

Figure 7:
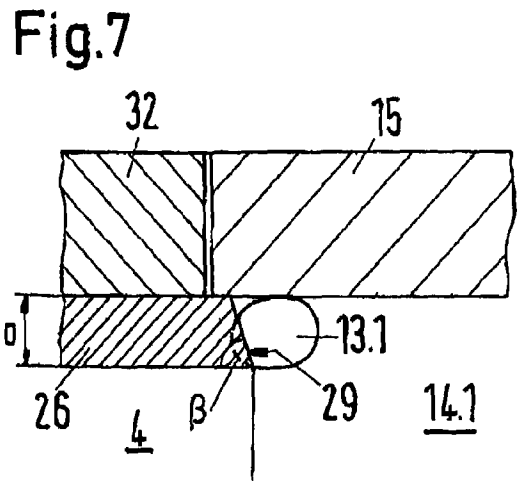
FIGS. 7, 7*a*, 7*b*, 8 and 8*a* show further embodiments of the invention.
Figure 7B:
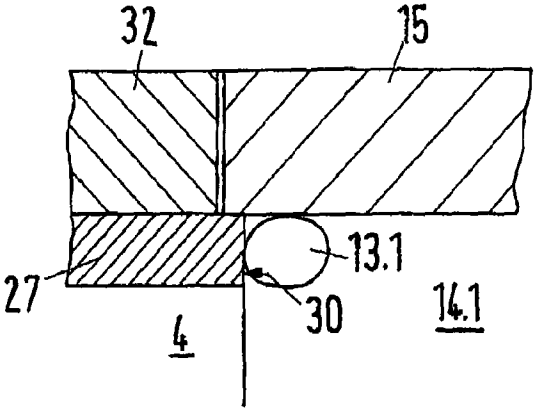
Figure 7A:
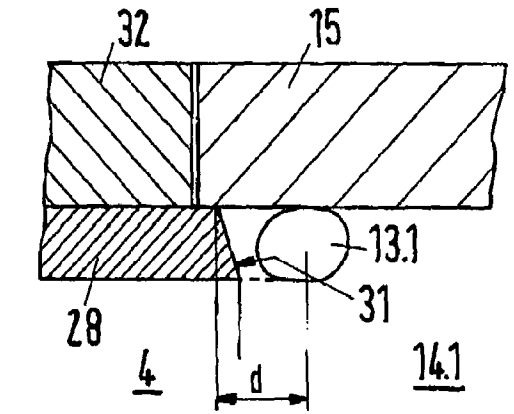

FIGS. 7, 7*a*, and 7*b* show different embodiments for the design of the step of the tunnel cladding. In all three Figures, it can be seen that the eddy chamber housing 15 connects to a housing 32 for the fiber guide element and the tunnel cladding. For the invention, it is irrelevant whether the eddy chamber housing 15 also comprises the housing 32 or whether there are two separate housings which connect to one another. The invention is capable of application in both cases.

The variant which is shown in FIG. 7 has a tunnel cladding 26 which is shaped in such a way that located at the end of the fiber conveying channel 4 is a step 29 with an inclination angle β. Preferably, the tunnel cladding 26 has a thickness a which falls within the range from 0.1 to 3 mm. Advantageously, the thickness a of the tunnel cladding amounts to 0.5 mm. It can be seen how the aperture of the jet nozzle 13.1 is arranged in the immediate vicinity of the face side of the step 29 in the eddy chamber housing 15. The step 29 in this context is arranged so close to the opening of the jet nozzle 13.1 that its face side serves as a deflection guide surface for the emerging flow. It can be seen in the Figure how the step 29 is arranged flush with the aperture. The aperture is likewise arranged flush with the inner surface or casing jacket surface of the eddy chamber 14.1, so that the aperture of the jet nozzle 13.1 runs "tangentially flush" into the inner side of the eddy chamber housing 15, or tangentially into the eddy chamber 14.1 respectively. Not identifiable in the Figure is the fact that the jet nozzle 13.1 can exhibit an inclination angle α to the direction of the material flow (see preceding Figures). The inclination angle α of the jet nozzle to the direction of the material flow can be used in a range from about 45° to 88°, preferably, in a range from about 58° to 75°. Advantageously, however, inclination angles to the material flow direction of α are used which are equal to about 60° or 70° (by relation to the angle α of the preceding Figures). The inclination angle β of the face side of the step 29 can exhibit a value which differs from the inclination angle α. The most-suitable inclination angle β can be best determined empirically for the specific application concerned. Experiments have revealed that in most cases an inclination angle β is suitable which exhibits the same value as the angle α. The invention, however, makes provision for the use of different angles.

The fact that the step can be arranged flush with the apertures can be identified particularly well from FIG. 7*b*. In this case, a tunnel cladding 27 exhibits a step 30 with a face side which even exhibits an inclination angle of 90°. The face side of the step can, however, also be flush if the inclination angle does not amount to 90° (see, for example, FIG. 7).

The fact that the apertures of the jet nozzles can also exhibit a distance interval to the step of the tunnel cladding is shown, for example, in FIG. 7*a*. A tunnel cladding 28 in FIG. 7*a* exhibits a step 31, which (measured from the foot of the step) exhibits a distance interval d to the geometrical mid-point of the hole 13.1.

Figure 1:
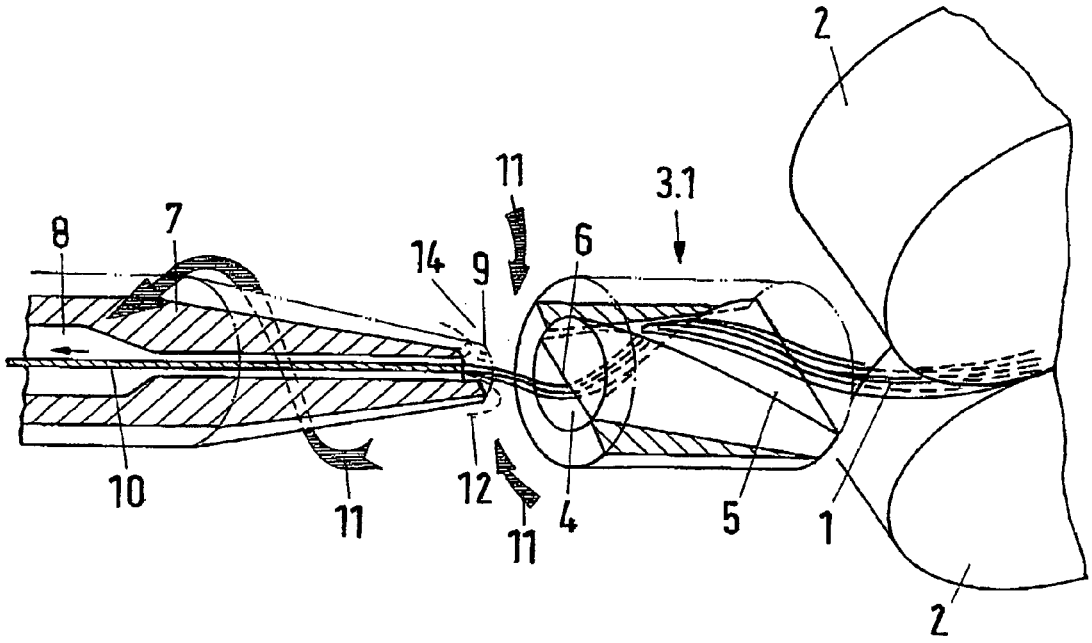
FIG. 1 shows prior art from Specification EP 854 214.
Figure 2:
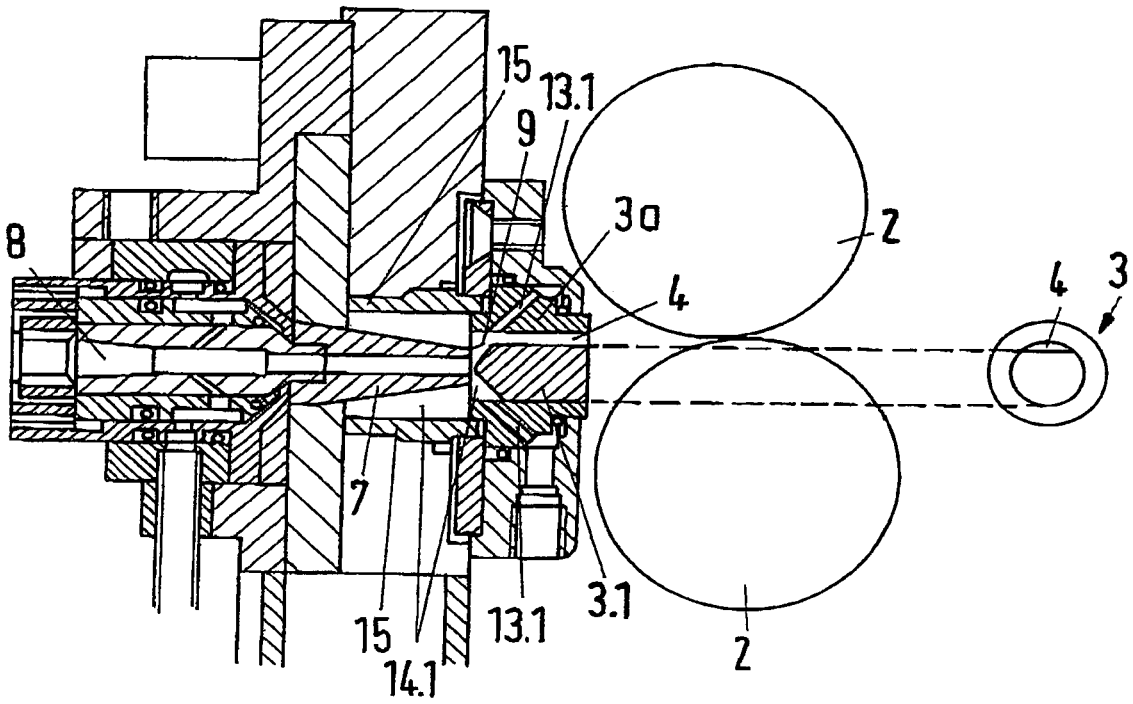
FIGS. 2 and 2*a* show prior art according to JP 3-10 63 68.
Figure 2A:
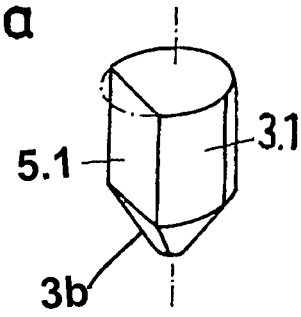
PRIOR ART Fig.2a

The thinking of the invention can be particularly well identified from the comparison of the steps shown in FIGS. 7, 7*a* and 7*b*. The idea is for a step or a surface (29, 30, 31) to be provided in the indirect or direct vicinity of the outlet apertures of the fluid device 13.1, which severs as a deflection guide surface for the emerging fluid (air). These deflection guide surfaces "conduct" the emerging flow or eddy flow in a suitable manner, so that the eddy current is optimally adapted to the requirements. The important point is that the steps (29, 30, 31) of the tunnel claddings (26, 27, 28), or possibly also the face surfaces of the fiber guide elements turned towards the eddy chamber 14.1 or delimiting it, conduct the eddy flow in a suitable manner. This is an important functional feature of the invention. The most suitable shape and arrangement of the step is to be selected for the individual application situation. The step can therefore be arranged flush with a corresponding inclination angle or at an appropriate distance interval to the outlet aperture of the jet nozzle 13.1. The most favorable variant is to be determined empirically in the specific application instance (e.g., as a function of the type or quality of the yarn which is to be produced). The aim in any event is for the step or also the face surface of the fiber guide element to be used as a deflection guide surface and, therefore, for optimum flow conditions or eddy currents, respectively, for the yarn formation to be achieved. The deliberate use of these surfaces as deflection guide surfaces for the eddy flow achieves marked improvements in the spinning process. Even though devices are known from the prior art which exhibit eddy chambers with steps (see, for example, FIG. 2), the principle was not hitherto known of designing such steps as deflection guide surfaces. Such steps known from the prior art were hitherto contained, for production engineering reasons, in the eddy chambers, or at least never had the function or placement according to the present invention.

Figure 8:
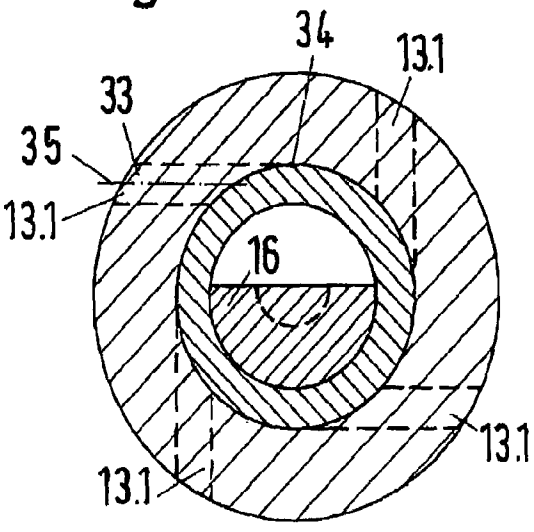
Figure 8A:
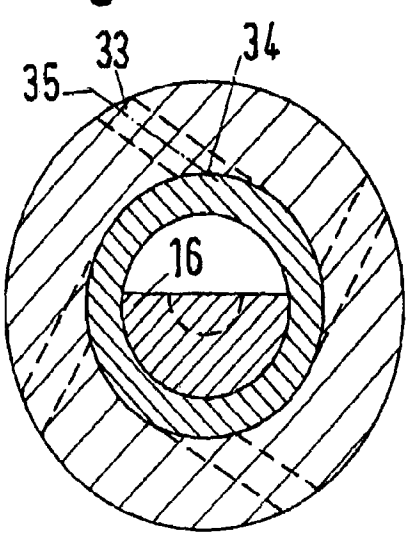

FIGS. 8 and 8*a* show preferred arrangements of jet nozzles 13.1. The two Figures correspond to the cross-section I—I from FIG. 3, with correspondingly adjusted aperture arrangements (in comparison with the arrangement of FIG. 3). It can readily be seen that the eddy chamber housing exhibits a circular inner surface and the aperture of each jet nozzle 13.1 runs "tangentially flush" into the inner surface of the eddy chamber housing. The invention can naturally also be applied to devices in which the apertures do not run tangentially into the cross-section of the eddy chamber housing. FIGS. 8 and 8*a* therefore show only preferred embodiments for the implementation of the invention. FIG. 8 shows a variant in which the longitudinal axis of the aperture 33 of one jet nozzle 13.1 runs parallel to the fiber guide surface 16. The tangential and flush transitions from the aperture to the circular inner surface of the eddy chamber accordingly takes place at the zenith point 34. Advantageously, the fluid device in the eddy chamber housing exhibits in total three or four rotationally symmetrical jet nozzles 13.1.

FIG. 8*a* shows four jet nozzles arranged rotationally symmetrical. By contrast to FIG. 8, however, the apertures are arranged rotated about the longitudinal axis of the device (compare with FIG. 8). Accordingly, the aperture 33 of the one jet nozzle can also be arranged in such a manner that its longitudinal axis 35 passes through the casing surface of the eddy chamber at the zenith point 34.

The aperture 33 of the one jet nozzle can also be arranged in an area between the two latter positions. Preferably, several jet nozzles are used, which are arranged or distributed rotationally symmetrical about the longitudinal axis of the device (see FIG. 8 or 8*a*).

The invention is suitable in particular for devices for air spinning, whereby air is used preferably as the fluid.

The invention is not restricted to the possibilities and embodiments explicitly referred to here. The variants described and shown are intended more as inspiration for the person skilled in the art to apply the idea of the invention in the most favorable manner possible for the individual situation. Accordingly, further advantageous arrangements and combinations can be easily derived from the embodiments described, which likewise reproduce the thinking of the invention and which are intended to be protected by this application. It is intended that the present invention include such modifications and variations as come within the scope of the appended claims and their equivalents.

What is claimed is:

1. A spinning device for spinning a yarn from a sliver of fibers, said device comprising;

an eddy chamber housing forming an eddy chamber wherein a fluid flows;

a spindle extending into said eddy chamber, said spindle defining an inlet aperture mouth through which said sliver is receivable as said sliver is being spun into said yarn and a yarn guide channel through which said yarn is movable;

at least one jet nozzle having an aperture defined therethrough disposed within said eddy chamber housing, said jet nozzle having said aperture that is openable into said eddy chamber and supplying said fluid into said eddy chamber that creates an eddy flow around said inlet aperture mouth of said spindle;

a fiber guide element proximal to said inlet aperture mouth of said spindle within said eddy chamber housing, said fiber guide element having a fiber guide surface for conveying said sliver into said eddy chamber towards said inlet aperture mouth of said spindle and a face surface which delimits said eddy chamber;

a tunnel cladding disposed around said fiber guide element, said tunnel cladding forming a fiber conveying channel with said fiber guide element wherethrough said fiber guide surface of said fiber guide element extends; and said tunnel cladding extending into said eddy chamber and forming a step within said eddy chamber housing, said step having a deflection guide surface for deflecting fluid emerging from said aperture of said at lest one jet nozzle.

2. A spinning device as in claim 1, wherein said at least one jet nozzle is disposed at an inclination angle within said eddy chamber housing.

3. A spinning device for spinning a yarn from a sliver of fibers, said device comprising;

an eddy chamber housing forming an eddy chamber wherein a fluid flows:

a spindle extending into said eddy chamber, said spindle defining an inlet aperture mouth through which said sliver is receivable as said sliver is being spun into said yarn and a yarn guide channel through which said yarn is movable;

at least one jet nozzle having an aperture defined therethrough disposed within said eddy chamber housing, said jet nozzle having said aperture that is openable into said eddy chamber and supplying said fluid into said eddy chamber that creates an eddy flow around said inlet aperture mouth of said spindle and said jet nozzle being disposed at an inclination angle within said eddy chamber housing;

a fiber guide element proximal to said inlet aperture mouth of said spindle within said eddy chamber housing, said fiber guide element having a fiber guide surface for conveying said sliver into said eddy chamber towards said inlet aperture mouth of said spindle and a face surface which delimits said eddy chamber;

a tunnel cladding disposed around said fiber guide element, said tunnel cladding forming a fiber conveying channel with said fiber guide element wherethrough said fiber guide surface of said fiber guide element extends;

said tunnel cladding extending into said eddy chamber and forming a step within said eddy chamber housing, said step having a deflection guide surface for deflecting fluid emerging from said aperture of said at lest one jet nozzle; and wherein said face surface of said fiber guide element exhibits about the same angle as said inclination angle of said at least one jet nozzle and extends into said eddy chamber.

4. A spinning device as in claim 2, wherein said face surface of said fiber guide element exhibits a greater angle than said inclination angle of said at least one jet nozzle and extends into said eddy chamber.

5. A spinning device as in claim 2, wherein said deflection guide surface of said step of said tunnel cladding exhibits about the same angle as said face surface of said fiber guide element.

6. A spinning device as in claim 1, wherein said deflection guide surface of said step of said tunnel cladding is flush with said aperture of said at least one jet nozzle.

7. A spinning device as in claim 3, wherein said angle of said face surface of said fiber guide element and said inclination angle of said at least one jet nozzle is about 45° to 88°.

8. A spinning device as in claim 3, wherein said angle of said face surface of said fiber guide element and said inclination angle of said at least one jet nozzle is about 58° to 75°.

9. A spinning device for spinning a yarn from a sliver of fibers, said device comprising;

an eddy chamber housing forming an eddy chamber wherein a fluid flows;

a spindle extending into said eddy chamber, said spindle defining an inlet aperture mouth through which said sliver is receivable as said sliver is being spun into said yarn and a yarn guide channel through which said yarn is movable;

at least one jet nozzle having an aperture defined therethrough disposed within said eddy chamber housing, said jet nozzle having said aperture that is openable into said eddy chamber and supplying said fluid into said eddy chamber that creates an eddy flow around said inlet aperture mouth of said spindle;

a fiber guide element proximal to said inlet aperture mouth of said spindle within said eddy chamber housing, said fiber guide element having a fiber guide surface for conveying said sliver into said eddy chamber towards said inlet aperture mouth of said spindle and a face surface which delimits said eddy chamber;

a tunnel cladding disposed around said fiber guide element, said tunnel cladding forming a fiber conveying channel with said fiber guide element wherethrough said fiber guide surface of said fiber guide element extends;

said tunnel cladding extending into said eddy chamber and forming a step within said eddy chamber housing, said step having a deflection guide surface for deflecting fluid emerging from said aperture of said at lest one jet nozzle; and wherein said tunnel cladding has a thickness of about 0.1 to 3 mm.

10. A spinning device as in claim 9, wherein said tunnel cladding has a thickness of about 0.5 mm.

11. A spinning device as in claim 1, wherein said eddy chamber housing comprises a circular inner surface defining a portion of said eddy chamber, and said at least one jet nozzle passing tangentially flush through said eddy chamber housing and into said eddy chamber.

12. A spinning device as in claim 1, wherein a longitudinal axis of said aperture formed by at least one of said at least one jet nozzle is about parallel to the fiber guide surface of said fiber guide element.

13. A spinning device as in claim 1, wherein a longitudinal axis of said aperture formed by at least one of said at least one jet nozzle intersects with a zenith point of a cross-section of said eddy chamber housing.

14. A spinning device as in claim 1, wherein three jet nozzles are disposed in a rotationally symmetrical arrangement within said eddy chamber housing.

15. A spinning device as in claim 1, wherein four jet nozzles are disposed in a rotationally symmetrical arrangement within said eddy chamber housing.

16. A spinning device as in claim 1, wherein said fiber guide surface of said fiber guide element exhibits a deflection point which causes a deflection of said sliver as said sliver travels over said fiber guide surface.

* * * * *